US005463367A

United States Patent [19]

Ellis

[11] Patent Number: 5,463,367

[45] Date of Patent: Oct. 31, 1995

[54] METHOD FOR FORMING THICK FILM RESISTORS AND COMPOSITIONS THEREFOR

[75] Inventor: Marion E. Ellis, Kokomo, Ind.

[73] Assignee: Delco Electronics Corp., Kokomo, Ind.

[21] Appl. No.: 136,058

[22] Filed: Oct. 14, 1993

[51] Int. Cl.[6] ..... H01C 1/012

[52] U.S. Cl. ..... 338/308; 338/20; 29/620; 252/518

[58] Field of Search ..... 338/308, 66, 306, 338/307, 309, 22, 195, 292, 293; 29/620, 610; 427/102, 123, 126; 106/47 R, 46; 252/518, 512; 361/406, 400

[56] References Cited

U.S. PATENT DOCUMENTS

| | | | |
|---|---|---|---|
| 3,304,199 | 2/1967 | Faber, Sr. et al. | 117/201 |
| 3,324,049 | 6/1967 | Holmes | 252/514 |
| 3,329,526 | 7/1967 | Daily et al. | 117/227 |
| 3,916,037 | 10/1975 | Brady et al. | 427/101 |
| 4,065,743 | 12/1977 | Wahlers et al. | 338/308 |
| 4,209,764 | 6/1980 | Merz et al. | 338/308 |
| 4,959,751 | 9/1990 | Hearn et al. | 361/406 |
| 5,098,611 | 3/1992 | Honda et al. | 252/518 |
| 5,379,016 | 1/1995 | Smith et al. | 338/308 |

*Primary Examiner*—Tu Hoang
*Attorney, Agent, or Firm*—Mark A. Navarre

[57] ABSTRACT

Thick film resistor ink compositions and a method for formulating and processing such inks are provided for producing thick film resistors having highly repeatable and stable resistance characteristics. The inks are specifically formulated to produce resistors whose resistivities are determined in part by the sintering temperature employed in the processing of the resistors. The processing of the inks involves using infrared radiation techniques to rapidly sinter the inks at highly controllable temperatures, so as to enable the resistance of a resistor to be predictably altered by the sintering operation, such that in-process adjustments can be made to the processing method. Thick film resistors produced in accordance with this invention are characterized by high stability to environmental influences and low TCR values on the order of about ±50 ppm/°C.

13 Claims, 5 Drawing Sheets

METHOD FOR FORMING THICK FILM RESISTORS AND COMPOSITIONS THEREFOR

The present invention generally relates to thick film resistors used in hybrid microcircuitry, and to the compositions and processing of such resistors. More particularly, this invention relates to an improved processing method by which thick film resistors are fabricated, in which the electrical characteristics of the resistors are more repeatably and accurately obtained, and to compositions for such resistors which enable the electrical characteristics of the resistors to be altered through in-process adjustments to the sintering temperature.

BACKGROUND OF THE INVENTION

Thick film resistors are employed in hybrid microcircuits to provide a wide range of resistor values, generally between about 0.1Ω and about 10MΩ. Such resistors are printed on a ceramic substrate using thick-film pastes, or inks, which are conventionally composed of an organic vehicle, a glass frit composition, an electrically conductive material, and various additives used to favorably effect the final electrical properties of the resistor. The organic vehicle determines the flow characteristics of the ink, while the glass frit composition primarily serves to adhere the electrically conductive material together, as well as bond the resistor to the substrate.

After printing, thick-film inks are typically dried by infrared radiation at temperatures of about 150° C. Thereafter, the printed pattern is sintered, or fired, to convert the ink into a suitable film which adheres to the ceramic substrate. Sintering typically occurs by transporting the printed pattern on a conveyer through a convection furnace. A time-temperature profile for a conventional sintering process is illustrated in FIG. 1*a*. The process is controlled to produce a heating rate of about 100° C. per minute, which is sufficiently slow to promote stability of the resistor and to allow the organic vehicle of the ink to burnoff. During sintering, which typically occurs at peak temperatures of about 825° C. to about 1000° C. for a duration of about 10 minutes, both physical and chemical changes occur to form the conduction network or microstructure of the resistor. Such changes involve a solidus to liquidus phase change for the glass frit composition, crystal growth of the conductive material, and changes in the oxidation state of the conductive material. The time and temperature relationships where these events occur determine the final microstructure of the resistor film, which in turn determines the resistivity, stability and temperature characteristics of the resistor. Various additives are used to shift the time and temperature relationships to achieve specific desired resistivity (Ω/□), stability and temperature characteristics.

Typically, inks are commercially available in composition families referred to as end-members, which are formulated to produce resistors having sheet resistances in decade values from about 1 ohm per square (Ω/□) to about 10 megohms per square (MΩ/□), (per 25 micrometers of dried thickness). Compositions having values which are one decade apart are referred to as adjacent end-members, which are blended to produce intermediate values of resistance. In addition, the resulting thick film resistors can be trimmed to increase their resistance values. Final resistance values of about ±1% can be achieved by trimming using abrasive or laser techniques.

However, the electrical resistance of a thick film resistor will vary with temperature, and may be permanently altered when subjected to a hostile environment. Such adverse effects are illustrated in FIG. 1*b*, which is representative of thick film resistors that have been laser trimmed to increase their resistances by about 30% after sintering. As can be seen in FIG. 1*b*, the change in resistance of a thick film resistor may average about 0.4% or more after being subjected to the test conditions indicated.

A thick film resistor's sensitivity to temperature is indicated by its temperature coefficient of resistance (TCR), as measured in parts per million per degree C (ppm/°C.). Thick film resistors can typically be calibrated to have a TCR in the range of about ±50 to about ±100 ppm/°C. Calibration to a tighter limit is generally prevented by a significant difference in the values for TCR obtained at −55° C. and 125° C., which are standard temperature extremes used by the industry to evaluate the electrical characteristics of thick film resistors, as well as blending anomalies which occur as a result of interactions between the additives included in the ink to selectively alter the electrical characteristics of the resistor. Such blending anomalies are particularly likely to occur when blending two adjacent end-members to obtain an intermediate resistance value. Such additives, which include noble metals and their compounds, refractory fillers, various glass frit materials, and modifiers, are conventionally added to end-members because they are capable of optimizing the performance of each end-member individually. The prior art which generally illustrates this approach includes U.S. Pat. No. 3,329,526 to Daily et al., U.S. Pat. No. 3,304,199 to Faber et al U.S. Pat. No 3,324,049 to Holmes et al., and U.S. Pat. No. 3,916,037 to Brady et al. However, such formulation techniques do not fully consider possible interactions between additives of two adjacent end-members. FIG. 1*c* provides an example of the variation in TCR which may occur when blending two adjacent end-members to form a resistor having a sheet resistance which is intermediate that of the two end-members. The TCR values are plotted for the −55° C. and 125° C. test temperatures conventionally used. As can be seen in FIG. 1*c*, a thick film resistor's TCR value vary significantly between the lower and upper test temperatures, such that conventional ink compositions cannot be readily formulated to exhibit low TCR values over a broad operating temperature range. TCR values also vary considerably over the blending range for the two end-members. Moreover, this variation is not proportional to the change in content of one end-member relative to the other, as one might be inclined to expect. Such a relationship between TCR and composition illustrates the adverse influence that interactions between additives can have on TCR values.

FIG. 1*d* illustrates another characteristic of prior art thick film resistors as a result of current processing techniques and formulations. An object of current thick film resistor compositions is the achievement of compositions whose sheet resistances (and therefore TCR, which is a function of sheet resistance) do not shift significantly with respect to sintering temperatures. Such a capability is necessary as a result of the inability to accurately control temperature variations within a convection furnace of the type conventionally used to sinter thick film resistors. Typically, production sintering specifications for such furnaces allow for about a ±10° C. variation around the target peak temperature for the sintering process. Consequently, prior art end-member compositions are targeted for resistance shifts within approximately ±5% and minimal TCR shifts over the 20° C. range, as illustrated in FIG. 1*d*.

However, to achieve minimal resistance and TCR shifts, tradeoffs have been made. For example, as noted previously, conventional ink compositions are formulated to include additives such that the resulting resistors have low sensitivity to the normal sintering temperature variations within conventional convection furnaces. When using a convection furnace to sinter thick film resistors, low sensitivity promotes a tight distribution around the target resistance for purposes of meeting the required TCR and TCR tracking specifications, meaning the allowable difference in TCR between two or more resistors, as well as maintaining resistance values within the allowable tolerance for allowing laser trim adjustments to achieve the desired final resistance value for the resistor. Generally, the less trimming required, the more stable the resistor to environmental conditions and also, the faster the throughput for the production process. However, due in large part to the additives used in ink compositions, the TCR values for some adjacent end-member compositions diverge significantly as the result of a change or variation in sintering temperature, producing the significant and generally unpredictable variations in sheet resistance depicted in FIG. 1*d*.

As a result, the electrical properties of such resistors cannot be selectively modified by altering the sintering temperature employed, because an adjustment in sintering temperature would not have a highly predictable effect on resistance, and a sintering temperature sufficient to alter the electrical properties of a resistor would typically be beyond the sintering range for a conventional ink composition. Consequently, when intervening processing conditions, such as changes in composition or local variances in furnace temperature, occur which undesirably alter the electrical properties of the resistors, current formulations for ink compositions do not readily allow for in-process modifications to bring subsequently produced resistors back within an acceptable range for the target resistance. Consequently, the use of conventional ink compositions necessitate that compositional changes be made, or that the source of the intervening factors be determined and eliminated. Consequently, significant yield losses result due to the inability to quickly bring the resistor values back into tolerance.

In addition, under the typical circumstances in which one or more different ink blends are required for a number of resistors in a given circuit, resistance values for the resistors can diverge in response to a given change in sintering parameters, as demonstrated in FIG. 1*d*, as a result of a chemical interaction between end-members of each ink composition. When resistance values diverge between resistors in a circuit, greater yield losses ultimately result. Furthermore, the likelihood of such an occurrence increases as the TCR values of the resistors increase.

From the above, it can be seen that present practices involving the formulation and processing of thick film resistors are generally inflexible in terms of producing resistors which can be accurately and repeatably processed to have low TCRs over a large operating temperature range. In addition, present practices do not generally allow for rapid in-process modifications which enable the resistances of such resistors to be continuously monitored and maintained within the target tolerance. Specifically, present ink compositions have been formulated to be insensitive to sintering temperatures, a processing step which could otherwise be utilized to advantageously influence the final resistance values for thick film resistors.

Accordingly, what is needed is a thick film resistor composition which enables the production of resistors having minimal TCR values, while also enabling in-process monitoring such that resistances of such resistors can be readily altered during the sintering operation to maintain production tolerance requirements.

SUMMARY OF THE INVENTION

It is an object of this invention to provide a thick film resistor composition which enables the electrical characteristics of thick film resistors produced therefrom to be modified by selectively altering the temperature at which the composition is sintered, yet are highly stable when subjected to hostile environments.

It is another object of this invention that such compositions exclude additives conventionally formulated to influence the temperature-dependent characteristics of the resulting resistor, such that a significant change in the resistor's TCR value will not occur as a result of chemical interactions between additives when forming resistors from blended compositions.

It is a further object of this invention to provide a method by which such a thick film resistor composition can be processed in order to produce resistors having TCR values which differ by no more than about 10 ppm/°C. between −55° C. and 125° C., yet having resistances which can be selectively altered by in-process adjustments to the sintering temperature.

It is yet a further object of this invention that such a method utilize infrared technology to achieve accurate temperature control during the sintering operation, so as to achieve an in-process capability to maintain the resistances of thick film resistors within a target resistance tolerance.

It is yet another object of this invention that such a method enable a high throughput process for manufacturing thick film resistors.

In accordance with a preferred embodiment of this invention, these and other objects and advantages are accomplished as follows.

According to the present invention, there is provided a thick film resistor composition, in the form of a paste or ink, for use in the production of thick film resistors suitable for use in hybrid microcircuitry. The ink is formulated to form resistors having electrical characteristics which can be predictably modified through altering the sintering temperature of the ink. Furthermore, the ink is formulated to produce resistors with TCR values which are substantially constant and on the order of no more than about ±50 ppm/°C., and which differ by no more than about 10 ppm/°C. between −55° C. and 125° C. Such TCR values are also substantially unaffected by variations in composition when two end-members are blended to achieve intermediate resistances. Inks formulated in accordance with this invention enable the adoption of a novel method by which thick film resistors are produced, wherein the process promotes production throughput, repeatability, and the ability to achieve resistances within a close production tolerance.

Generally, the method of this invention encompasses infrared radiation techniques which, when used instead of conventional convection furnaces, are able to closely tailor the sintering temperature of the thick film resistor composition of this invention, so as to be able to selectively affect the final resistance characteristics of the resulting resistor. Such a capability allows for the use of in-process monitoring and correcting of the resistances by appropriately adjusting the sintering temperature. Furthermore, infrared heating techniques enable increased heating rates, which reduce the time required to fully sinter the ink composition.

Ink compositions in accordance with this invention generally include an electrically conductive material, a glass frit composition which serves to bond the electrically conductive material together and bond the resulting resistor to a substrate, and an organic vehicle that determines the flow characteristics of the ink during printing of the ink on a substrate. Notably absent from the ink composition are additives which are conventionally present in such compositions. In accordance with the teachings of this invention, the lack of such additives are compensated for to some extent by selectively formulating the glass frit composition in order to minimize the temperature dependence of the resistor's TCR value. In addition, and contrary to prior art compositions in which such additives are included in ink formulations to make the ink substantially insensitive to variations in the sintering temperature, resistors formed with the ink compositions of this invention are intentionally formulated to have resistance characteristics which can be altered by the temperature at which the inks are sintered. With such a capability, resistors formed in accordance with the method of this invention can be more readily produced to have resistances within a target production range through appropriately adjusting the sintering temperature.

Another advantage of this invention is that resistors formed with the preferred ink compositions exhibit high stability when exposed to hostile environments. Such a capability is achieved without the additives conventionally used in the prior art, such that potentially less costly compositions and processing techniques are possible.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings wherein.

DETAILED DESCRIPTION OF THE INVENTION

A thick film resistor paste and a method for formulating and processing such a paste are provided for producing thick film resistors having highly repeatable and stable resistance characteristics. The paste, or ink, is specifically formulated to produce resistors whose resistivities are determined in part by the sintering temperature employed in the processing of a resistor. The processing of the ink involves using infrared radiation techniques to rapidly sinter the ink at highly controllable temperatures, so as to enable the resistivity of a resistor to be predictably altered by the sintering operation, such that in-process adjustments can be made to the processing method. Thick film resistors produced in accordance with this invention are characterized by high stability to environmental influences and low TCR values.

Referring to FIG. 1, a heating profile is shown which is illustrative of a convection furnace which is conventionally used in the sintering of thick film resistor inks. Previously, thick film resistor inks have been formulated to include a glass frit composition, an electrically conductive material, various additives, and an organic vehicle. Typical glass frit compositions include litharge (PbO; also known as lead oxide, yellow and lead monoxide), boric acid ($H_3BO_3$) which serves as a source for boron oxide ($B_2O_3$), silicon dioxide ($SiO_2$), aluminum oxide ($Al_2O_3$), titanium oxide ($TiO_2$), cupric oxide (CuO), and manganese oxide ($MnO_2$) or manganese carbonate ($MnCO_3$) as a source for manganese oxide. Preferred electrically conductive materials are typically iridium dioxide ($IrO_2$), ruthenium dioxide ($RuO_2$) or a ruthenate, while suitable organic vehicles include ethyl cellulose dissolved in terpineol. As noted previously, additives used in ink compositions of the prior art include the noble metals and their compounds, refractory fillers, various glass frit materials, and modifiers. Such additives generally are intended to optimize the performance of an individual end-member in terms of promoting insensitivity to the sintering temperature used, as well as stability to hostile environments. However, their use is disadvantageous in terms of chemical interactions during processing, which cause anomalies which are detrimental to process and quality control, as previously discussed.

Figure 1A:
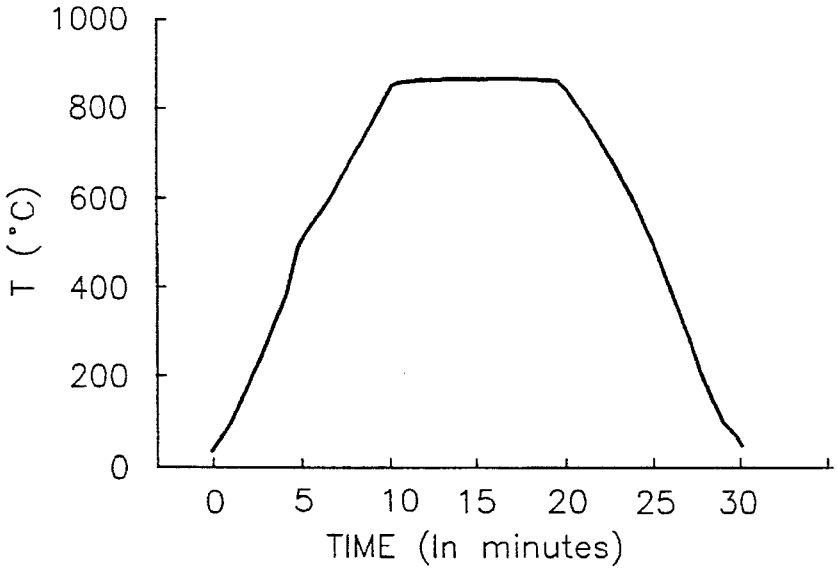
FIG. 1a PRIOR ART
FIGS. 1*a* through 1*d* show a heating profile, stability characteristics, TCR variations, and sheet resistance variations, respectively, for thick film resistors formed in accordance with the prior art.

Typically, substrates on which such inks have been printed are fed through a convection furnace on a conveyor belt at a rate which achieves the profile shown in FIG. 1*a*. The targeted heating and cooling rates are about 100° C. per minute, which is conventionally believed to be sufficiently slow to promote stability of the resistor and to allow the organic vehicle of the ink to burn off. Historically, faster heating and cooling rates have not been advocated due to fear that faster rates would promote instabilities after laser trimming and exposure to hostile environments. Accordingly, heating techniques such as infrared technologies, which are capable of significantly faster heating rates, have not been exploited widely in the prior art other than to dry the inks prior to sintering. In addition, the prior art has generally considered greater heating and cooling rates to be detrimental in terms of achieving repeatable and relatively stable TCR values, and particularly the tendency for TCR values to change with variations in temperature.

Figure 1B:
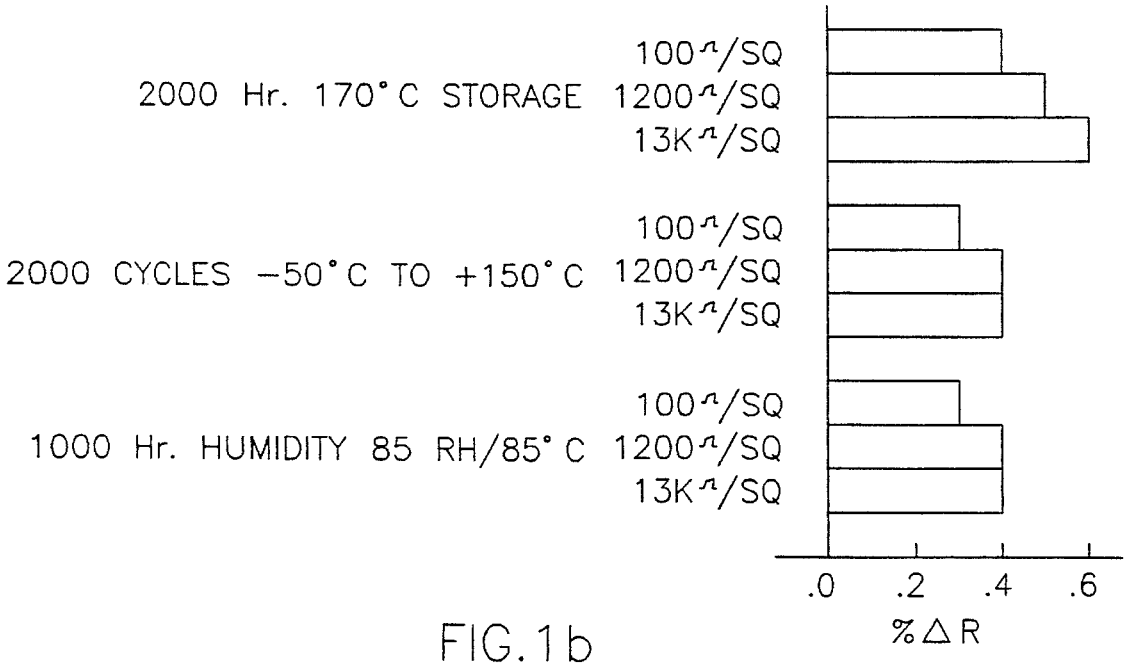
FIG. 1b PRIOR ART
Figure 1C:
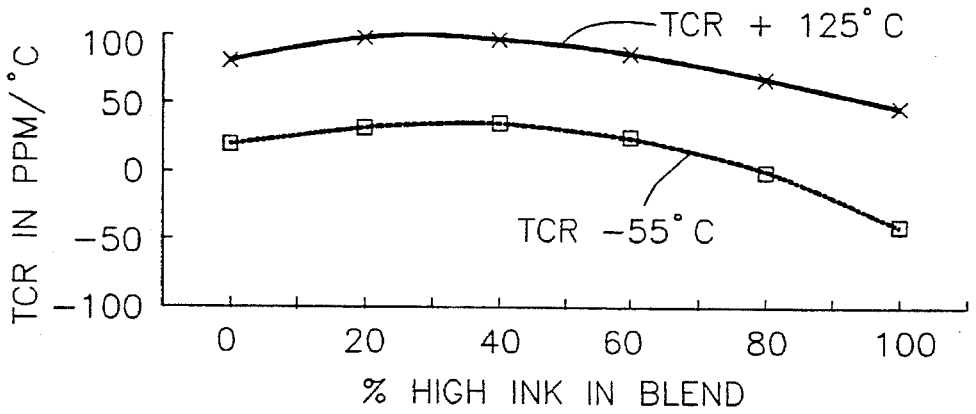
FIG. 1c PRIOR ART
Figure 1D:
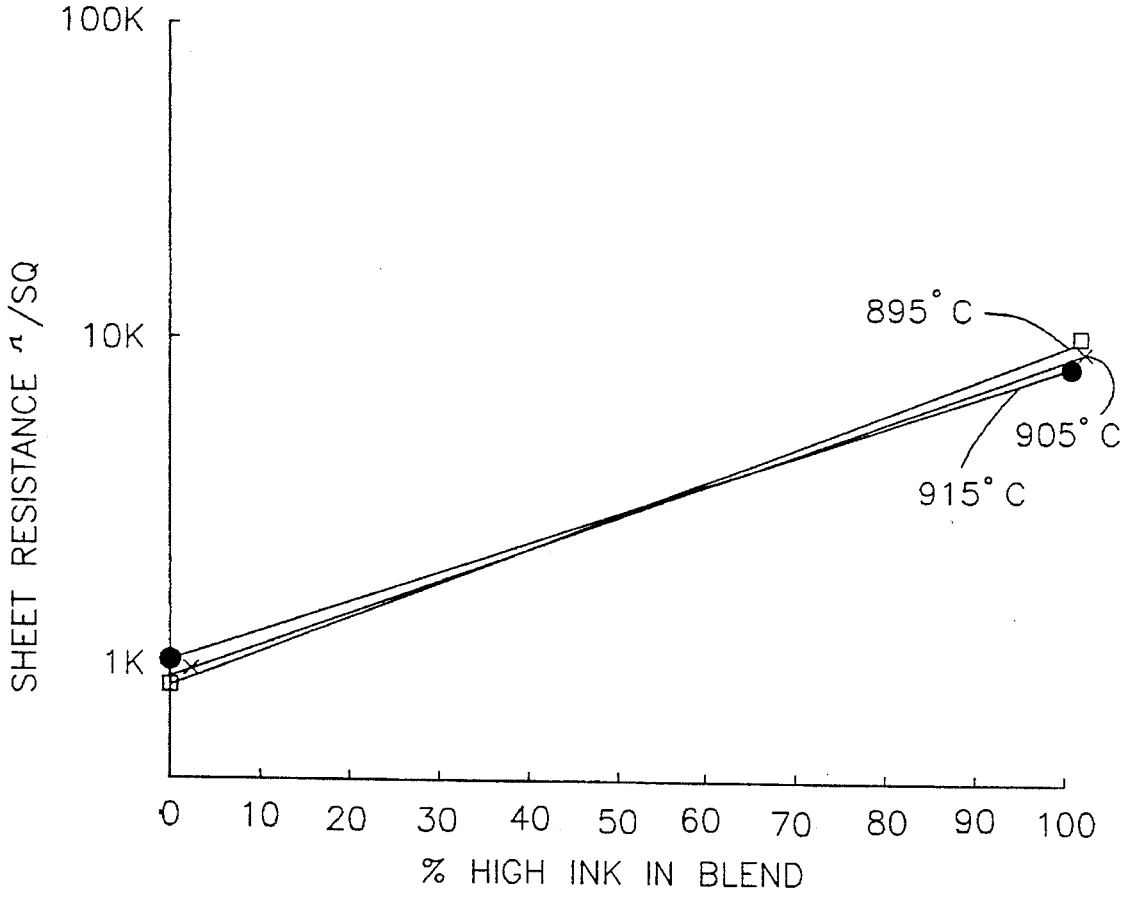
FIG. 1d PRIOR ART

Stabilities illustrative of thick film resistors formed in accordance with the prior art are shown in FIG. 1*b*. As noted previously, current practices typically produce resistors having stability characteristics which may change by as much as 0.4% or more when exposed to test environments such as those indicated in FIG. 1*b*. Stabilities are designated in terms of the sheet resistance of the resistor, indicated by resistivity of the resistor per unit thickness, or ohms/square (Ω/□). The TCRs of resistors formulated in accordance with the prior art tend to be sensitive to temperature, as well as to the relative presence of admixed end-members for achieving intermediate resistances, as illustrated in FIG. 1*c*. Lastly, resistors formed from conventional ink compositions are formulated to be relatively insensitive to the sintering temperature employed, as indicated in FIG. 1*d*.

In contrast to that shown for the prior art, the present invention seeks to provide a thick film resistor ink which is compatible with infrared furnace technologies and adaptive process control methods. More specifically, thick film resistor ink compositions of this invention exclude conventional additives, and instead rely on selectively formulating a glass frit composition which provides the controlling chemistry of the ink composition, and therefore determines the stability and TCR characteristics for the thick film resistors produced therefrom. In addition, the glass frit composition can be specifically formulated to take advantage of the unique capabilities offered by infrared furnaces. In accordance with this invention, glass frit constituents such as litharge, boric acid, silicon dioxide, and aluminum oxide have been identified as contributing to the stability of a resistor's TCR value when the resistor is subjected to temperature changes. Furthermore, additional glass frit constituents such as titanium oxide and manganese oxide are used to move the TCR value of the ink in a negative direction, while cupric oxide is used to move the TCR value in a positive direction.

Therefore, the ink compositions within the scope of this invention generally contain three ingredients: the electrically conductive material, preferably iridium dioxide, ruthenium dioxide, or a ruthenate such as bismuth ruthenate or lead ruthenate; a selected glass frit composition; and a suitable organic vehicle, such as ethyl cellulose in terpineol. Notably, additives which are intended and conventionally used to affect the resistance characteristics of the ink are intentionally omitted from the compositions of this invention.

Suitable ink compositions formulated in accordance with this invention can be made by weighing and mixing the above ingredients in proper proportions, and then roll milling the mixture using conventional equipment such as a three-roll-mill to achieve optimum dispersion and fineness. Preferably, the particles are reduced to a particle size of about 0.00025 to about 0.00075 inch in diameter, with the composition having a consistency suitable for use with known thick film printing techniques. Thereafter, the milled composition is printed onto a suitable ceramic substrate using a thick film printing technique, such as a screen printing method, and the printed composition is then dried at about 125° C. to about 150° C. for about 10 to about 15 minutes. Finally, the composition is sintered as indicated by the heating profile shown in FIG. 2. In accordance with this invention, sintering is performed in an infrared furnace which has the capability of very precise temperature control of an article being heated. Such furnaces typically include a conveyor belt which is routed through several heated zones whose temperatures are precisely controlled by a solid state digital control. While conventional convection furnaces are generally capable of controlling temperatures within about a ±10° C. range, infrared furnaces are capable of controlling temperatures within an approximately ±1° C. range for temperatures of about 825° C. to about 1000° C.

Figure 2:
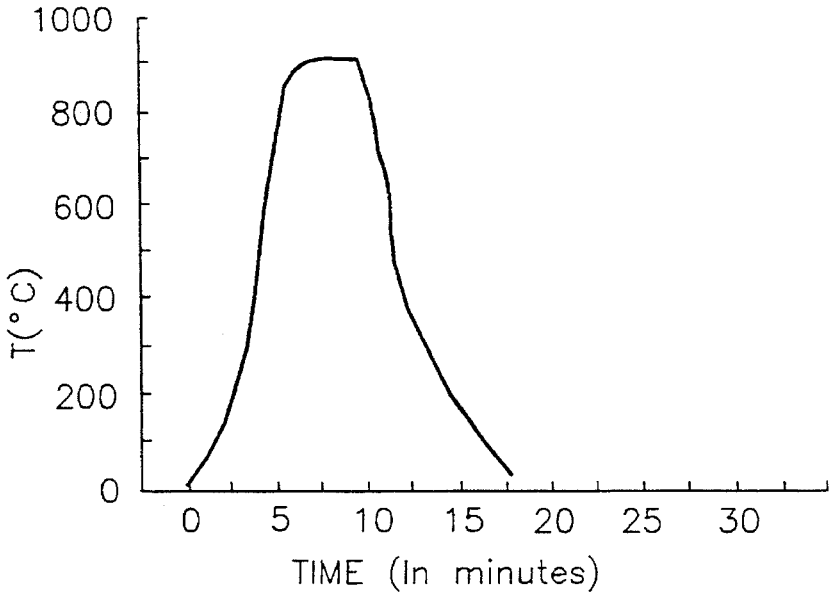
FIG. 2 shows a heating profile utilized to sinter thick film resistor inks formulated in accordance with this invention.

As a result, and in contrast to what has been possible in the prior art, a time-temperature profile such as that shown in FIG. 2 can be achieved using an infrared furnace. Importantly, such a heating profile can be successfully employed to sinter the ink compositions of this invention and form a thick film resistor, without degrading the stability or TCR characteristics of the resistor. The heating profile of FIG. 2 generally includes a heating and cooling rates of about 190° C. to about 300° C. per minute, and more preferably about 200° C. per minute, with a preferred hold temperature of about 895° C. to about 925° C. for a duration of about five minutes. As a result of the heating capability of infrared furnace technology, the duration for the heating cycle required to sinter a thick film resistor ink can be less than the 30 minute sintering cycle utilized by the prior art, as shown in FIG. 1*a*, and may be 15 minutes or less, as shown in FIG. 2. Potentially, throughput can be substantially increased as a result of the relatively short heating cycle made possible with the use of infrared technology. Cooling is preferably achieved by methods which are generally conventional for an infrared furnace of the type previously described, which often utilize a three stage cooling process using a transition cooldown section, a rapid water cooldown section, and a turbulent air cooldown section.

Specific ink compositions which were formulated and processed to be compatible with the above processing methods are described below. While such ink compositions are exemplary as to the formulations which will achieve the performance objects of this invention, those skilled in the art will recognize that an infinite number of combinations are possible within the scope of the invention. Generally, the ink compositions of this invention are characterized by the identification and development of specific glass frit mixtures which are formulated to produce resistors having minimum differences between TCR values when measured at −55° C. and 125° C., preferably on the order of about 10 ppm/°C. or less. More specifically, the ink compositions of this invention are formulated on the basis that differences in TCR values are a function of the frit composition used. The following exemplary compositions serve to illustrate this finding.

The seven glass frit compositions listed below were each used to form ink compositions in accordance with this invention. These particular frit compositions were chosen as a result of an experimental design to evaluate the interaction of each chemical compound in concert relative to resistivity, TCR and TCR spread.

| | Frit Composition in weight percent | | | | | |
|---|---|---|---|---|---|---|
| | PbO | $H_3BO_3$ | $SiO_2$ | $Al_2O_3$ | $TiO_2$ | CuO |
| Frit #1 | 53.3 | 15.1 | 19.4 | 10.2 | 1.0 | 1.0 |
| Frit #2 | 53.3 | 15.1 | 19.4 | 8.2 | 1.0 | 3.0 |
| Frit #3 | 67.0 | 15.1 | 11.0 | 0.4 | 1.7 | 4.8 |
| Frit #4 | 52.3 | 16.1 | 19.4 | 8.2 | 1.0 | 3.0 |
| Frit #5 | 51.3 | 17.1 | 19.4 | 8.2 | 1.0 | 3.0 |
| Frit #6 | 52.3 | 17.1 | 19.4 | 8.2 | 1.0 | 2.0 |
| Frit #7 | 52.9 | 20.2 | 21.2 | 2.3 | 2.4 | 1.0 |

About 52.5 grams of each of the above frit compositions were combined with about 32.5 grams of a terpineol/ethyl cellulose solution (the organic vehicle) and about 15.0 grams of bismuth ruthenate ($Bi_2Ru_2O_7$) to form a like number of ink compositions. These compositions were mixed and roll milled to form ink compositions, which were then printed and dried for about 10 to about 15 minutes at about 150° C. prior to sintering within an infrared furnace according to the heating profile shown in FIG. 2. The resulting resistors were then tested without trimming to determine their TCR values at test temperatures of −55° C. and 125° C. Analysis of this data indicated that the differences in TCR values at these temperatures strongly correlated with that of the particular constituents used in the individual ink compositions. This relationship was determined mathematically to be approximately:

$$\Delta=0.085A+0.241B+0.245C-0{,}066D-9{,}486$$

Where:

Δ=Difference in TCR at −55° C. and 125° C. (ppm/°C.)

A=Weight percent PbO

B=Weight percent $H_3BO_3$

C=Weight percent $SiO_2$

D=Weight percent $Al_2O_3$

The validity of the above relationship was established by the close fit of the values mathematically derived from the equation with the actual test data, as shown below:

| | Difference in TCR at −55° C. and 125° C. (ppm/°C.) | |
|---|---|---|
| | Actual | Predicted |
| Frit #1 | 15.0 | 9.0 |
| Frit #2 | −23.0 | −25.0 |
| Frit #3 | −41.0 | −41.0 |
| Frit #4 | −39.0 | −35.0 |
| Frit #5 | −43.0 | −45.0 |
| Frit #6 | −9.0 | −9.0 |
| Frit #7 | 75.0 | 75.0 |

An additional ink composition with Frit #2 as the glass frit constituent was then formulated, as well as an eighth frit composition (Frit #8). Frit #8 was formulated on the basis of the above equation to achieve an ink composition whose change in TCR between −55° C. and 125° C. would be roughly zero, as follows:

| | Frit Composition in weight percent | | | | | |
|---|---|---|---|---|---|---|
| | PbO | $H_3BO_3$ | $SiO_2$ | $Al_2O_3$ | $TiO_2$ | CuO |
| Frit #8 | 53.0 | 15.0 | 19.3 | 8.1 | 1.6 | 3.0 |

The titanium dioxide and cupric oxide levels used were chosen to alter the TCR value, as previously described, while the remaining constituents, in accordance with this invention, served to minimize the change in TCR between the test temperatures.

From these two frit compositions, two sample ink compositions were formulated. Sample 1 consisted of about 35 weight percent a terpineol/ethyl cellulose solution, about 15 weight percent ruthenium dioxide ($RuO_2$), and about 50 weight percent of Frit #8, while Sample 2 consisted of about 31 weight percent the terpineol/ethyl cellulose solution, about 3 weight percent ruthenium dioxide and about 66 weight percent of Frit #2. These ink compositions were then printed, dried at about 150° C. for about 10 to about 15 minutes, and then sintered in accordance with the heating profile of FIG. 2 at about 915° C. for about three minutes, producing resistors whose untrimmed electrical characteristics were as follows:

| | Sample 1 | Sample 2 |
|---|---|---|
| Sheet Resistance (Ω/□) | 559 | 14,700 |
| TCR at 125° C. (ppm/°C.) | 40 | −26 |
| TCR at −55° C. (ppm/°C.) | 40 | −33 |
| ΔTCR between −55° C. and 125° C. | 0 | −7 |

From the above, it can be seen that the Sample 1 ink composition was successfully formulated to minimize the change in TCR values (ΔTCR) between the test temperatures employed. Furthermore, the changes detected for the samples were substantially less than that typically achievable with conventional ink compositions that include additives to optimize the resistance characteristics of a thick film resistor. Also, the TCR values obtained were within about ±50 ppm/°C., which is less than what is typically considered as a minimum for conventional ink compositions that include additives. Those skilled in the art will recognize that resistors formed from the above ink compositions can be calibrated to obtain production TCR values of essentially zero ppm/°C. for Sample 1 and about ±3.5 ppm/°C. for Sample 2. Such calibration techniques include adding very small amounts of titanium oxide to Sample 1 to move its TCR value in the negative direction toward zero, and adding very small amounts of cupric oxide to Sample 2 to move its TCR value in the positive direction toward zero. As end-members, Samples 1 and 2 can also be blended to form intermediate ink compositions whose resistance characteristics include TCRs of about ±3.5 ppm/°C. for a production system.

To illustrate this capability, the above sample compositions were blended in accordance with standard practices to produce resistors whose sheet resistances were intermediate that of the combined end-members. A first sample, identified as Sample 3, was composed of about 70 weight percent of Sample 1 and about 30 weight percent of Sample 2, while a second sample, identified as Sample 4, was composed of about 30 weight percent of Sample 1 and about 70 weight percent of Sample 2. These ink compositions were processed in a substantially identical manner to that for Samples 1 and 2 to produce resistors having the following characteristics:

| | Sample 3 | Sample 4 |
|---|---|---|
| Sheet Resistance (Ω/□) | 1140 | 3600 |
| TCR at 125° C. (ppm/°C.) | 37 | 20 |
| TCR at −55° C. (ppm/°C.) | 38 | 18 |
| ΔTCR between −55° C. and 125° C. | −1 | 2 |

The above data demonstrate that resistors having selected sheet resistances, and TCR values within a range of about ±50 ppm/°C. and which differ by no more than about 10 ppm/°C. between −55° C. and 125° C. can be produced using the ink compositions and processing method of this invention. Compositions having substantially higher (such as about 1 MΩ□) and lower sheet resistances (such as about 1 Ω/□) can also be formulated by altering the amounts of titanium oxide and cupric oxide in the glass frit used; and/or altering the amounts of each used in calibration; and/or altering the amounts of litharge, boric acid, silicon dioxide, and aluminum oxide from that indicated for Frits #1 through #8 on the basis of similar experimentation; and/or by blending such ink compositions to form intermediate blends.

Figure 3:
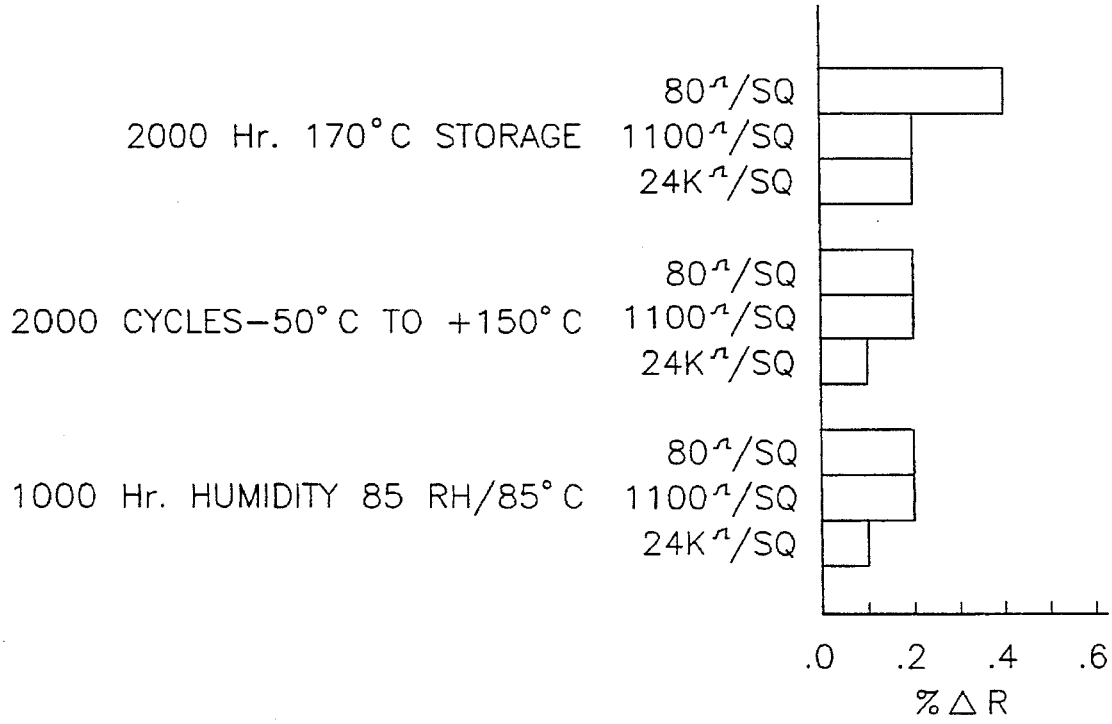
FIG. 3 illustrates stability characteristics of thick film resistors formed in accordance with this invention.

Stability characteristics of thick film resistors formed in accordance with this invention are provided in FIG. 3, which represents data acquired through substantially identical test procedures as that shown for the prior art in FIG. 1*b*. The resistor compositions were fabricated in accordance with the teachings of this invention to form resistors whose resistivities (or resistivity decades) approximated that of the prior art resistors represented in FIG. 1*b*. Generally, the resistors were laser trimmed to increase their resistance by about 30%, as was also done with the resistors formed according to the prior art teachings. However, the average percent change in resistance is roughly half that of the prior art. Accordingly, the resistors formed according to the method of this invention exhibited an improvement by a factor of about two over substantially identically tested resistors formulated and processed according to prior art methods.

Figure 4A:
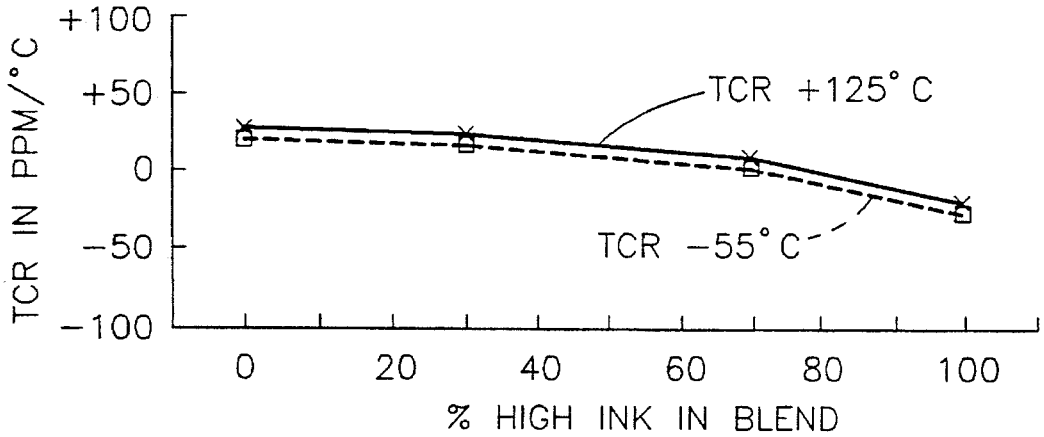
FIGS. 4*a* and 4*b* illustrate the relative insensitivity to blending and temperature which resistors exhibit when formulated and processed in accordance with this invention.
Figure 4B:
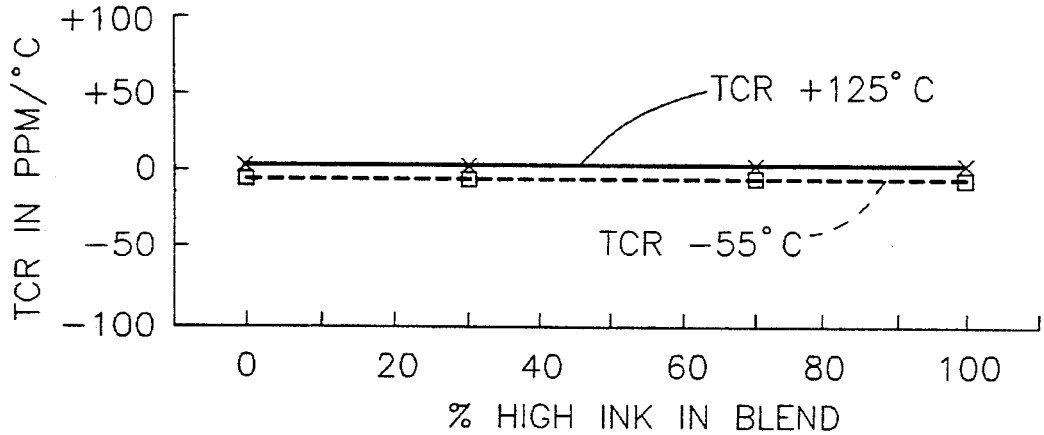

FIG. 4*a* illustrates the relative insensitivity which ink compositions of this invention exhibit with respect to temperature and blending influences. Specifically, and in contrast to similar data for prior art ink compositions represented in FIG. 1*c*, TCR values of resistors formed in accordance with this invention are significantly more stable to temperature changes, as indicated by the relatively small change in TCR values between the −55° C. and 125° C. test temperatures. Furthermore, because resistance properties are a function of the glass frit composition used, the TCR values achieved are closer to zero than that previously possible with prior art ink compositions, because the glass frit composition can be selectively mixed for this purpose. Finally, because the influence that the blending of two end-members have on TCR values has been substantially eliminated by omitting conventional additives, TCR values remain relatively stable over the blending range for two adjacent end-members. FIG. 4*b* also is illustrative of the above, and further demonstrates the ability of thick film resistor inks of this invention to exhibit TCR values to be stabilized at nearly zero over the entire blending range for two end members, as well as between test temperatures of −55° C. and 125° C. The compositions of FIG. 4*b* are identical to those represented in FIG. 4*a*, but with additions of about 0.05% titanium oxide added to the low resistivity end member and about 0.05% cupric oxide added to the high resistivity end member.

Figure 5:
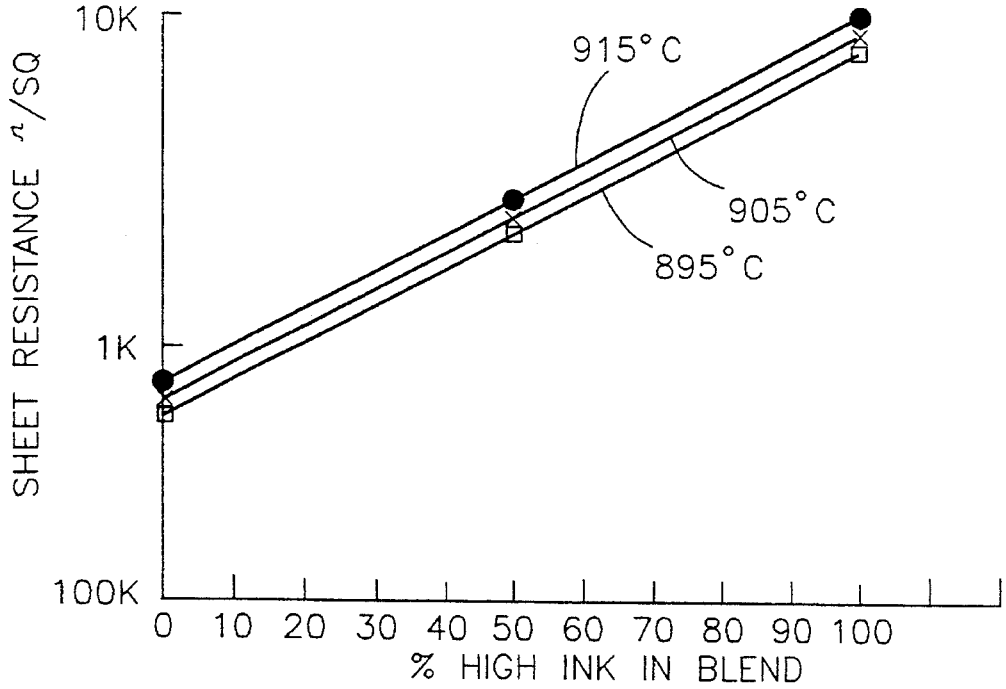
FIG. 5 illustrates the distinct and predictable variations in resistance which can be achieved as a result of altering the sintering temperature of ink compositions formulated and processed in accordance with this invention.

In addition to the above attributes, by omitting the additives conventionally found in thick film resistor inks of the prior art, the ink compositions of this invention exhibit significant resistance shifts as a result of temperature changes in the sintering temperature. Preferably, the ink compositions of this invention are targeted for resistance shifts of approximately +1% per degree C change in peak sintering temperature within a preferred peak sintering temperature range of about 895° C. to about 915° C. Consequently, the resistance of a resistor formed from an ink composition of this invention, as well as their blends, shifts in the same direction and to the same degree when the peak sintering temperature is adjusted up or down from the nominal peak sintering temperature of about 905° C. FIG. 5 illustrates this relationship for sintering temperatures of 895° C., 905° C. and 915° C., and clearly demonstrates the substantial change in sheet resistance which can be achieved by selectively altering the peak sintering temperature during sintering of the ink compositions formulated in accordance with this invention. Therefore, in conjunction with the temperature control capability made possible by using an infrared furnace in place of a convection furnace, the resistances of resistors formed from these ink compositions can be altered by selectively and precisely adjusting the temperature at which the ink compositions are sintered.

Such capability allows much tighter control and accuracy relative to the achievement and maintenance of a resistance target value during a production run, even when multiple resistor compositions are required for a single circuit. As noted before, as a result of the ink compositions taught by the prior art, a change in sintering temperature can have diverging affects on the resistances of multiple resistors formed on a substrate. In contrast, when processing ink compositions of this invention, a change in sintering temperature will cause a predictable shift in resistance, in which all resistances will either increase or decrease, corresponding to whether the sintering temperature was increased or decreased, respectively. Eliminating the potential for diverging resistance values promotes achieving and maintaining a target value during production runs, and reduces the degree of laser trimming required to achieve the final resistance value, such that stability and reliability is improved.

Finally, the above processing capabilities enable the adoption of in-process, adaptive control techniques which facilitate the ability to achieve and maintain target resistance values during production. More specifically, synchronous or continuous flow manufacturing techniques are enabled which employ a relatively simple, closed-loop feedback control for sintering the ink compositions by interfacing a computer with the electronic control circuits of the infrared furnace. As a result, as resistors leave the infrared furnace, the resistors can be tested to determine their resistances as compared to their target resistance values. When resistances are determined to be near or beyond the required target tolerance, the infrared furnace can be immediately and automatically adjusted to either increase or decrease the peak sintering temperature, as conditions require, in order to appropriately increase or decrease the resistances of the resistors in process. Because infrared furnaces are able to respond almost instantaneously to achieve about ±1° C. control, scrappage is minimized because fewer resistors will be produced which exhibit resistances outside the target production tolerance. The relatively short sintering cycle for the infrared furnace further promotes this capability, as well as throughput.

Figure 6:
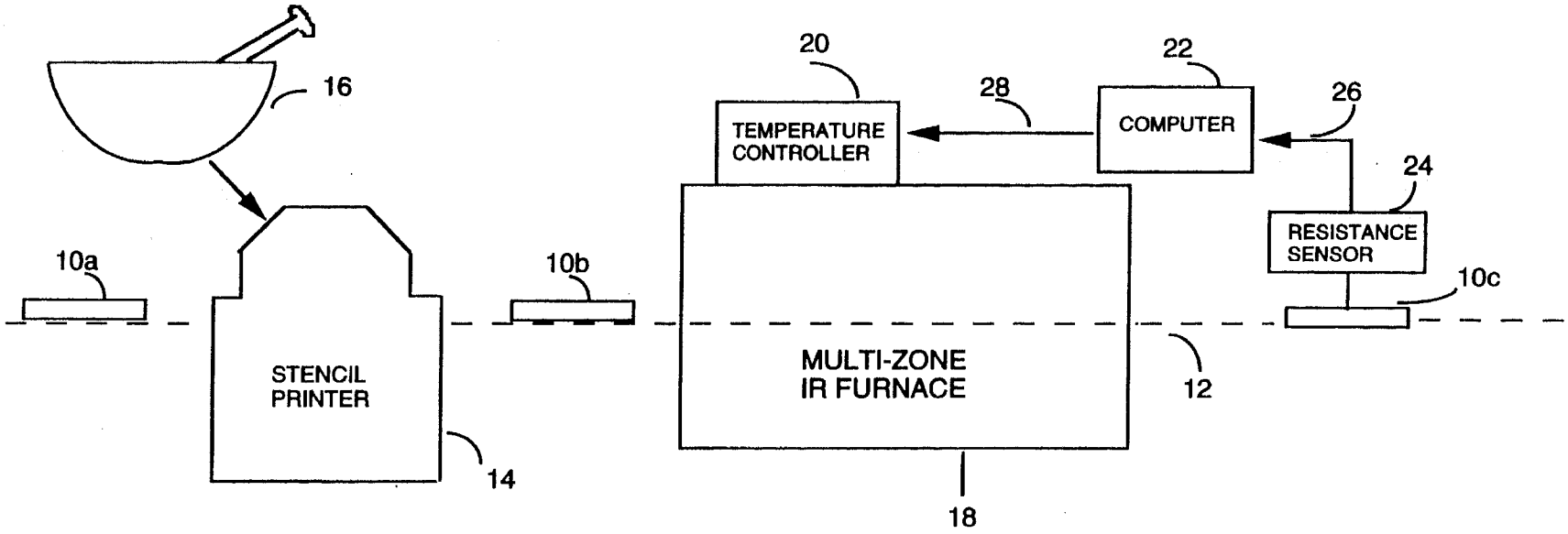
FIG. 6 schematically illustrates the process of this invention.

The above described process is schematically depicted in FIG. 6, where a number of substrates 10*a*–10*c* are shuttled from station to station on a conveyor belt 12. An unprinted substrate 10*a* is shuttled into an automated stencil printer 14 such as the Ultraprint 3000, manufactured and sold by MPM Corporation, Franklin, Mass., USA. Thick film ink material is mixed as indicated at mixer 16 and loaded into the stencil printer 14 for programmed application to the substrate 10*a*. The printed substrate 10*b* is then shuttled to a multi-zone IR furnace 18, such as the S-1500, manufactured and sold by Radiant Technology Corporation, Anaheim, Calif., USA. In the first heating zone, the printed substrate 10*b* is dried for 10–15 minutes at about 150° C., as described above. In subsequent heating zones, sintering occurs as the dried substrate is heated to higher temperatures according to the heating profile shown in FIG. 2. The furnace 18 includes a solid state digital temperature controller 20 for maintaining desired temperatures in each of the heating zones. A computer 22 interfaces with the temperature controller 20 for establishing and adjusting the desired temperature profile. The sintered substrate 10*c* is shuttled to a resistance sensor 24 which measures the resistance of the sintered thick film material and provides an output signal to computer 22 via line 26. The computer determines if the measured resistance is within the required target tolerance, and if not, signals the temperature controller 20 via line 28 to suitably adjust the peak sintering temperature in order to appropriately adjust the resistances of the resistors in process.

From the above, it can be seen that a significant advantage of this invention is that thick film ink compositions which are suitable for use in the production of thick film resistors can be readily formulated to form resistors having resistance characteristics which can be predictably altered by adjusting the temperature at which the inks are sintered. Furthermore, the inks can be formulated to produce resistors with very low TCR values which are substantially constant, even when exposed to temperature extremes. Such TCR values are also substantially unaffected by variations in composition when two end-members are blended to achieve intermediate resistances.

In addition, the inks formulated in accordance with this invention enable the use of infrared heating techniques which promote throughput and repeatability of resistance characteristics, as well as enable the resistance characteristics to be altered in-process to continuously achieve resistances within close production tolerances. Specifically, because infrared furnaces can precisely control the temperature at which the inks are sintered, the method of this invention can be used to selectively adjust the sheet resistance of the resistors, thereby reducing the amount of scrappage during production.

Another advantage of this invention is that resistors formed with the preferred ink compositions exhibit high stability when exposed to hostile environments. Such a capability is achieved without the additives conventionally used in the prior art, such that potentially less costly compositions and processing techniques are possible.

While our invention has been described in terms of a preferred embodiment, it is apparent that other forms could be adopted by one skilled in the art; for example, by modifying the relative amounts and types of glass frit components, organic vehicle and electrically conductive material in the ink compositions to form thick film resistors having higher or lower sheet resistances and/or TCRs, or by blending such ink compositions to form resistors having intermediate resistance properties, or by modifying the parameters at which such ink compositions are processed, such as the temperature at which an ink composition is sintered. Accordingly, the scope of our invention is to be limited only by the following claims.

The embodiments of the invention in which an exclusive property or privilege is claimed are defined as follows:

1. A method for forming a thick film resistor, said method comprising the steps of:

forming a thick film resistor paste, said thick film resistor paste being formulated such that said thick film resistor formed therefrom exhibits substantially predictable electrical properties which are selectively modified by altering the temperature at which said thick film resistor paste is heated to form said thick film resistor;

depositing said thick film resistor paste on a substrate;

drying said thick film resistor paste; and heating said thick film resistor paste in an infrared heating device, such that said thick film resistor paste is heated to a temperature and for a duration which are sufficient to form said thick film resistor and bond said thick film resistor to said substrate, and such that said temperature affects said electrical properties of said thick film resistor.

2. A method as recited in claim 1 wherein said thick film resistor paste has a composition consisting essentially of:

an organic vehicle;

a glass frit mixture; and an electrically conductive material.

3. A method as recited in claim 2 wherein said glass frit mixture comprises litharge, boric acid, silicon dioxide, and aluminum oxide.

4. A method as recited in claim 2 wherein said electrically conductive material is selected from the group consisting of iridium dioxide, ruthenium dioxide, and ruthenates.

5. A method as recited in claim 1 wherein said thick film resistor is characterized by a temperature coefficient of resistance range of no more than about ±50 ppm/°C., and a difference in temperature coefficient of resistance values of no more than about 10 ppm/°C. when measured at temperatures of about −55° C. and about 125° C.

6. A method as recited in claim 1 wherein said temperature is about 895° C. to about 915° C.

7. A method as recited in claim 1 wherein said duration is less than about 30 minutes.

8. A method for forming a thick film resistor for a hybrid microcircuit, said method comprising the steps of:

forming a thick film resistor paste having a composition consisting essentially of an organic vehicle, a glass frit mixture, and an electrically conductive material, said glass frit mixture being formulated such that said thick film resistor exhibits substantially predictable electrical properties which are selectively modified by altering the temperature at which said thick film resistor paste is sintered to form said thick film resistor;

depositing said thick film resistor paste on a substrate;

drying said thick film resistor paste; and sintering said thick film resistor paste by transporting said thick film resistor paste through an infrared heating device such that said thick film resistor paste is heated to a temperature and for a duration which are sufficient to form said thick film resistor and bond said thick film resistor to said substrate, and such that said temperature affects said electrical properties of said thick film resistor.

9. A method as recited in claim 8 wherein said glass frit mixture consists essentially of litharge, boric acid, silicon dioxide, aluminum oxide, and at least one material selected from the group consisting of titanium oxide, cupric oxide, manganese oxide, and manganese carbonate.

10. A method as recited in claim 8 wherein said thick film resistor is characterized by a temperature coefficient of resistance range of no more than about ±50 ppm/°C., and a difference in temperature coefficient of resistance values of no more than about 10 ppm/°C. when measured at temperatures of about −55° C. and about 125° C.

11. A method as recited in claim 8 wherein said temperature is about 895° C. to about 915° C.

12. A method as recited in claim 8 wherein said duration is less than about 30 minutes.

13. A method as recited in claim 8 further comprising the steps of providing feedback based on at least one of said electrical properties of said thick film resistor, and adjusting said temperature at which said thick film resistor paste is sintered in response to said feedback.

* * * * *